US005698125A

United States Patent [19]

Kwon

[11] Patent Number: 5,698,125

[45] Date of Patent: Dec. 16, 1997

[54] MICROWAVE OVEN IN COMBINATION WITH INDUCTION HEATING COOKER

[75] Inventor: Kyung Ahn Kwon, Seoul, Rep. of Korea

[73] Assignee: LG Electronics Inc., Rep. of Korea

[21] Appl. No.: 574,395

[22] Filed: Dec. 18, 1995

[30] Foreign Application Priority Data

May 9, 1995 [KR] Rep. of Korea ..... 11270/1995

[51] Int. Cl.[6] ..... H05B 6/12; H05B 6/76

[52] U.S. Cl. ..... 219/680; 219/601; 219/738; 174/35 R; 174/35 MS

[58] Field of Search ..... 219/601, 680, 219/736, 738, 740, 742, 743; 174/35 MS, 35 GC, 35 R

[56] References Cited

U.S. PATENT DOCUMENTS

| | | | |
|---|---|---|---|
| 3,206,536 | 9/1965 | Goodloe | 174/35 GC |
| 4,211,910 | 7/1980 | Kusunoki et al. | 219/740 |
| 4,414,425 | 11/1983 | Bogner | 174/35 GC |
| 5,110,651 | 5/1992 | Massard et al. | 174/35 MS |
| 5,177,333 | 1/1993 | Ogasawara | 219/680 |
| 5,334,800 | 8/1994 | Kenney | 174/35 R |

FOREIGN PATENT DOCUMENTS

| | | | |
|---|---|---|---|
| 63-281377 | 11/1988 | Japan | 219/601 |
| 2-183993 | 7/1990 | Japan | 219/601 |

*Primary Examiner*—Philip H. Leung

*Attorney, Agent, or Firm*—Ostrolenk, Faber, Gerb & Soffen, LLP

[57] ABSTRACT

In a microwave oven in combination with induction heating cooker, a shielding plate is mounted on a bottom surface of a heating chamber and an induction coil is provided below the shielding plate in order to cut off microwave provided when cooking food by microwave and to transmit a high frequency magnetic field generated in an induction heating cooking, to thereby selectively performing induction heating cooking and microwave cooking. The microwave oven includes a shielding plate having a first metal line part where a plurality of metal lines are parallely arranged at regular intervals and a second metal line part where a plurality of metal lines are also parallely arranged at regular intervals being crossed to the first metal line part at a predetermined angle, and an induction coil being disposed below the shielding plate for generating an induction current when power is supplied.

8 Claims, 4 Drawing Sheets

MICROWAVE OVEN IN COMBINATION WITH INDUCTION HEATING COOKER

BACKGROUND OF THE INVENTION

1. Field of the Invention

The present invention relates to a microwave oven in combination with an induction heating cooker in which a shielding plate is mounted on a bottom surface of a heating chamber and an induction coil is provided below the shielding plate in order to cut off microwave energy provided when cooking food by microwaves and to transmit a high frequency magnetic field generated in an induction heating cooking, to thereby selectively perform the induction heating cooking and the microwave cooking.

2. Description of the Prior Art

Referring to FIG. 1, a conventional microwave oven in combination with an induction heating cooker includes a control unit 1 for controlling the entire operation of the microwave oven according to a user's selection; a power supply unit 2 for supplying power to the inside of the microwave oven; relay switches 3*a* and 3*b* for outputting the power supplied from the power supply unit 2 after being switched by the control unit 1; an induction coil 4 for generating a high-frequency magnetic field for induction heating cooking upon receipt of the power supplied via the relay switches 3*a* and 3*b;* a transformer 5 for converting the power supplied through the relay switches 3*a* and 3*b* to a high voltage; a magnetron 6 for generating microwave energy from the high voltage converted by the transformer 5; a wave guide 8 for supplying the microwave energy generated by the magnetron 6 to a heating chamber 7; a non-magnetic metal grillwork 9 being mounted on the bottom surface of the heating chamber 7 for transmitting and providing the high-frequency magnetic field generated by the induction coil 4 to the heating chamber 7 or for cutting off the microwave energy being supplied to the heating chamber 7 through the wave guide 8; a turntable motor 11 for driving a turntable 10 mounted in the heating chamber under the control of the control unit 1; and a frying pan 13 mounted on the turntable 10 for cooking food 12.

The non-magnetic metal grillwork 9 is made of a thin stainless steel wire formed in a plain type. Practically, the non-magnetic metal grill 9 has at least ten meshworks so as to effectively cut off the microwave energy provided to the heating chamber 7 through the wave guide 8 within tolerance and also has twenty-five meshworks at maximum so as to reduce to a predetermined level a heating loss of the high frequency magnetic field for the induction heating cooking.

An operation of the conventional microwave oven in combination with the induction heating cooker as constructed above will now be described.

First, after food 12 is placed in the frying pan 13 by a user, as a frying pan key provided at the control unit 1 is input, the relay switches 3*a* and 3*b* are switched to terminals A and B, and then power is supplied to power supply unit 12 and also supplied to the induction coil 4 through the relay switches 3*a* and 3*b,* thereby performing an induction heating cooking process.

In other words, since current flows to the induction coil 4, a high frequency magnetic field of 20–30 kHz is generated. This high frequency magnetic field is sequentially applied to the turntable 10 and the frying pan 13 through non-magnetic metal grillwork 9 having ten to twenty five meshworks, so as to cook the food 12 placed on the flying pan 13.

On the other hand, when the user selects the microwave cooking process, the relay switches 3*a* and 3*b* are switched to the terminals 3C and 3D, by which the power from the power supply unit 12 is supplied to the transformer 13 through the relay switches 3*a* and 3*b*. The power supplied to the transformer 13 is converted to a high voltage and applied to the magnetron 6.

Then, the magnetron 6 generates microwaves of 2.45 GHz due to the high voltage applied from the transformer 5, and the microwave energy is applied to the heating chamber 7 through the wave guide 8.

The microwave energy provided to the heating chamber 7 is cut off by the non-magnetic metal grillwork 9, so that the food 12 placed on the frying pan 1 is cooked by the microwaves.

However, as to the conventional microwave oven in combination with induction heating cooker of which the non-magnetic metal grillwork has ten to twenty-five meshworks, the area of the metal grillwork, namely the length by height thereof is obtained as follows. That is, in case that the metal grillwork is formed with twenty-five meshworks, since the area of the bottom surface of the microwave oven is usually calculated as 330×350 mm, thus, 330/5×350/5=66×70 mm, while in case that it is formed by twelve meshworks, the area is calculated by 330/3×350/4=110×87.5 mm.

In this respect, in order to effectively cut off the microwave energy, the length of each side of the meshworks is to be densely formed approximately below 1 mm. Therefore, by adopting such a construction of the non-magnetic metal grillwork, the microwave energy would hardly be cut off, resulting in a problem of failing in properly cooking the food.

In addition, even if the non-magnetic metal grillwork has meshworks which are more closely formed by having more than twenty-five for the purpose of cutting off the microwave energy, as the non-magnetic metal grillwork is formed in a plain mesh type, there occurs a passage of eddy current against the magnetic field vertical to the plane. In other words, since dielectrization is not made at the orthogonal point of the horizontal side and the vertical side of the thin stainless steel, induction heating loss occurs, resulting in an abnormal cooking in the induction heating cooking.

SUMMARY OF THE INVENTION

Therefore, an object of the present invention is to provide a microwave oven in combination with an induction heating cooker in which a shielding plate is mounted on a bottom surface of a heating chamber and an induction coil is provided below the shielding plate in order to cut off microwave energy provided when cooking food by microwaves and to transmit a high frequency magnetic field generated in an induction heating cooking, to thereby selectively perform the induction heating cooking and the microwave cooking.

In order to obtain the above object, the microwave oven in combination with an induction heating cooker includes a shielding plate having a first metal line part wherein a plurality of metal lines are parallely arranged at regular intervals and a second metal line part wherein a plurality of metal lines are parallely arranged at regular intervals being crossed with the first metal line part at a predetermined angle, and an induction coil being disposed below the shielding plate for generating induction current when power is supplied.

DETAILED DESCRIPTION OF THE INVENTION

Figure 1:
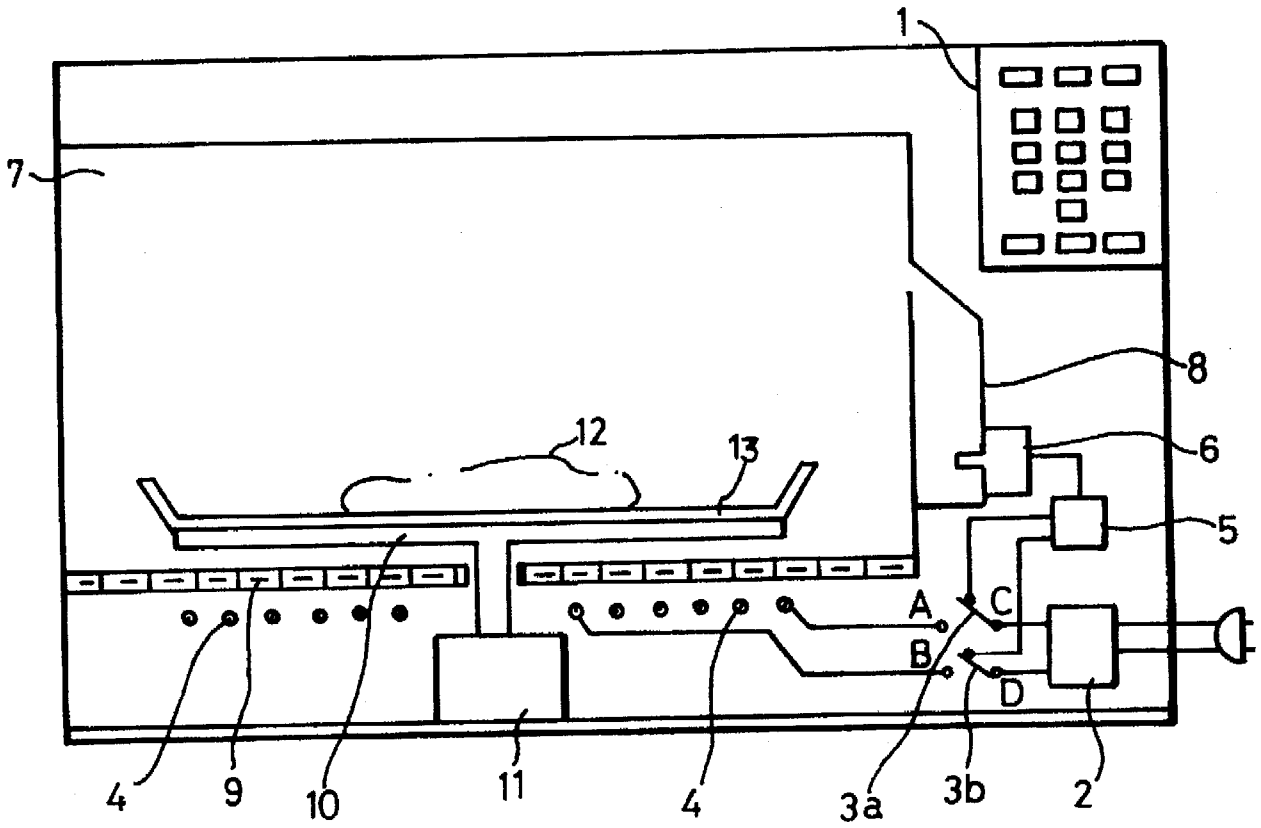
FIG. 1 CONVENTIONAL ART
FIG. 1 is a view of a conventional microwave oven in combination with an induction heating cooker.
Figure 2:
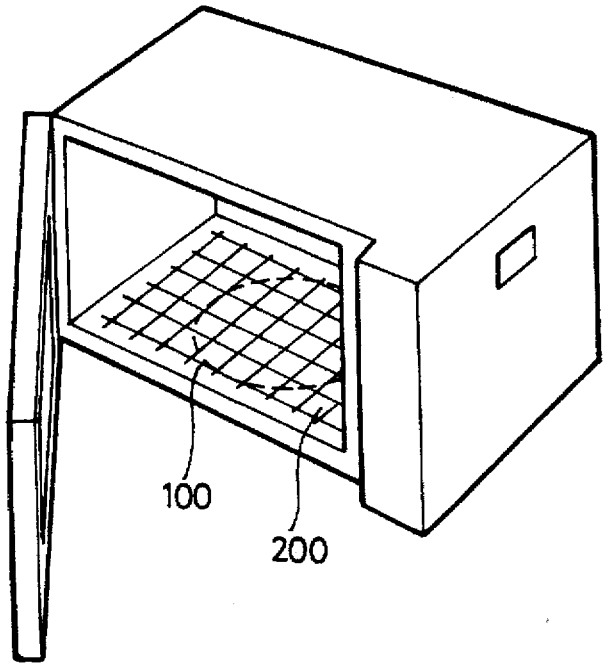
FIG. 2 is a view of a microwave oven in combination with an induction heating cooker in accordance with the present invention.

With reference to FIG. 2, the microwave oven in combination with an induction heating cooker includes an induction coil 100 for generating a high frequency magnetic field for induction heating cooking upon receipt of power; and a shielding plate 200 being mounted on the induction coil 100 for transmitting the high frequency magnetic field for the induction heating cooking generated at the induction coil 100 while cutting off microwave energy provided in microwave cooking. The other construction features are the same as that of the conventional microwave oven.

Figure 3A:
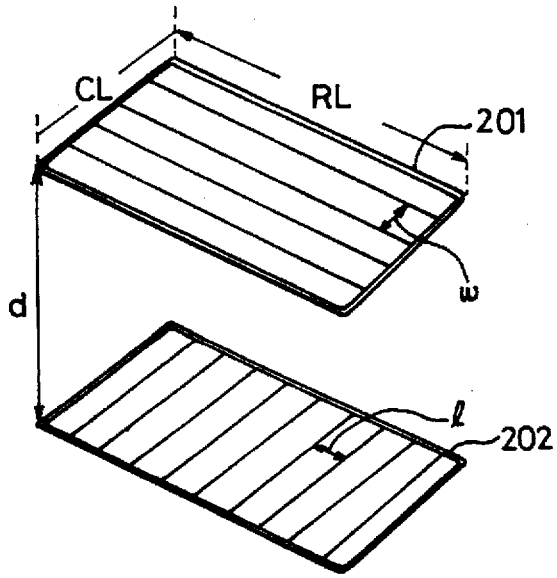
FIGS. 3A to 3D are views showing a shielding plate of FIG. 2.

The shielding plate 200, as shown in FIG. 3A, may have a first metal line part 201 wherein a plurality of metal lines are parallely arranged at a horizontal pitch "w" interval, and a second metal line part 202 wherein a plurality of metal lines are parallelly arranged at a vertical pitch "T" interval isolated from the first metal line part 201 within such a range of the facing distance "d" that the microwave energy can be cut off thereby.

The shielding plate 200 is provided with an insulating material between the first metal line part 201 and the second metal line part 202 where the facing distance "d" exists.

Figure 3B:
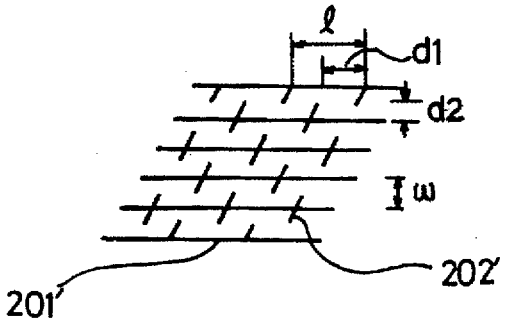

In addition, as shown in FIG. 3B, the shielding plate 200 may have a first metal line part 201' wherein a plurality of metal lines are parallely arranged at a horizontal pitch "w" interval, and a second metal line part 202' being formed in the same plane as the first metal line part 201' in such a mutually alternately crossing manner that two arbitrary alternate metal lines of the second metal line part 202' are arranged vertically at a predetermined distance "d1" and horizontally at a predetermined distance "d2", two arbitrary vertical metal lines of the second metal line part 202' in the same metal line of the first metal line part 201' having the distance "T" and each vertical metal line 202' arranged at every other line of the first metal line part 201' having a length equal to the width "w".

Each metal line forming the first and the second metal line parts 201' and 202' in the shielding plate 200 of FIG. 3B is coated with an insulating material in order to reduce a heating loss in the induction heating cooking.

Figure 3C:
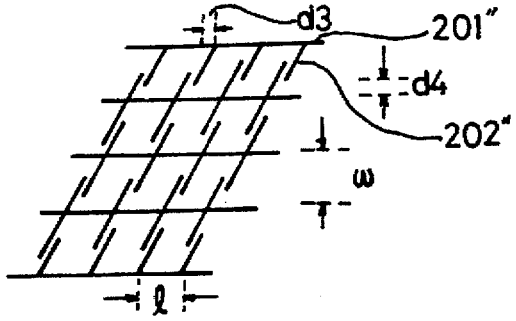

Moreover, as shown in FIG. 3C, the shielding plate 200 may have a first metal line part 201" wherein a plurality of metal lines are parallely arranged at a horizontal pitch "w" interval, and a second metal line part 202" being formed in the same plane as the first metal line part 201" in such a mutually alternately crossing manner that two arbitrary alternate metal lines of the second metal line part 202" are arranged vertically at a predetermined distance "d3" and horizontally at a predetermined distance "d4", two arbitrary vertical metal lines of the second metal line part 202" in the same metal line of the first metal line part 201" having the distance "T" and each vertical metal line of the second metal line part 202" arranged at every other line of the first metal line part 201" being slightly longer than the width "w" so that each end portion of two arbitrary vertical lines at the predetermined distance "d3" is arranged to be closely faced.

Each metal line forming the first and the second metal line parts 201" and 202" in the shielding plate 200 of FIG. 3C is coated with an insulating material in order to reduce a heating loss in the induction heating cooking.

Figure 3D:
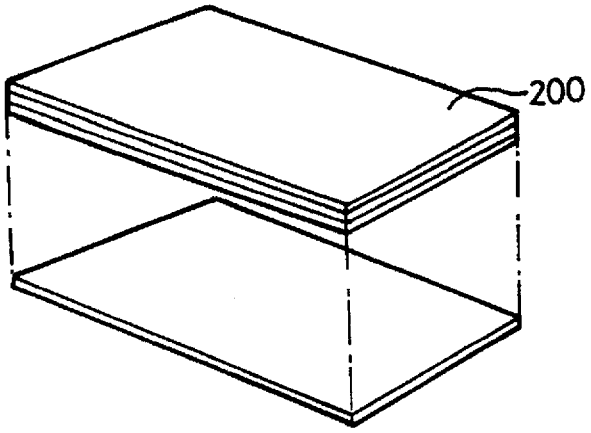

Furthermore, as shown in FIG. 3D, the shielding plate 200 may also be formed by stacking a plurality of shielding plates shown in FIG. 3(A) by as many as predetermined number.

The shielding plate 200 of FIG. 3D is also formed by inserting an insulating material between the first metal line part 201 and the second metal line part 202.

Also, as shown in FIG. 3D, the shielding plate 200 may be formed by folding a plurality of the shielding plates shown in FIG. 3B or FIG. 3C as many as predetermined number.

Each metal line forming the first metal line part 201' and the second metal line part 202' or the second metal line part 201" and the second metal line part 202" of the stacked shielding plates of FIG. 3D is coated with an insulating material.

Operation of the microwave oven in combination with the induction heating cooker according to the present invention as constructed above will now be described with reference to the accompanying drawings.

First, in order to calculate the capacity of a shielding plate 200 which cuts off microwave energy when the microwave energy is provided into a heating chamber of the microwave oven, the radiant energy can be measured which is radiated by the shielding plate 200 in both eases that the heating chamber is not loaded, namely, that no food is provided therein, and that the heating chamber is loaded with 1,000 cc of food.

The shielding plate 200, as shown in FIG. 3A to 3D, is formed with a diameter of 150 mm.

That is, it is assumed that the shielding plate 200 shown in FIG. 3A is formed having its diameter of 150 mm, for explanation purposes.

The horizontal pitch "w" at the first metal line part(201) of the shielding plate 200 having the diameter of 150 mm is formed at 1.2 mm, while the vertical pitch "T" at the second metal line part 202 is formed at 1.2 mm.

The facing distance "d" between the first metal line part 201 and the second metal line part 202 is formed at 0.2 mm, while the width between each metal line is formed at 0.125 mm.

The shielding plate 200 as constructed above is fixed to the surface of a door of the microwave oven, around which an aluminum plate is attached in order to prevent any transmission of microwaves.

Under the condition, energy radiated at the heating chamber of the microwave oven when microwave energy was provided was measured. The result was that radiant energy below 30 mW was measured in case that the heating chamber was not loaded, while radiant energy below 5 mW was measured in case that the heating chamber was loaded with food of 1,000 CC.

Consequently, it is judged that the cut-off performance against the microwave energy of the shielding plate 200 having such construction as in FIGS. 3A and 3D is preferable. In this respect, the cut-off performance against the microwave energy can be highly improved by optimizing the width, the horizontal pitch "w", the vertical pitch "l", the facing distance "d" and the distances "dl–dt" of the shielding plate 200.

In the meantime, in the induction heating cooking, a high frequency magnetic field below 100 kHz is generated by the induction coil and is transmitted to the shielding plate 200. In this respect, in order to measure the magnetic field transmission performance, thermal efficiency was measured in both cases of cooking the food with the shielding plate 200 mounted on an induction heating cooker and cooking the food without the shielding plate 200.

As to the shielding plate 200, its horizontal length "RL" is 109.3 mm, its vertical length "CL" is 54.6 mm, its horizontal pitch "w" is 1.2 mm, its vertical pitch 1 is 1.2 mm, and the width of each metal line is 0.125 mm. The thermal efficiency in both cases of mounting the shielding plate 200 on the induction heating cooker and of not mounting it was measured as shown in the table below by adopting the below formula 1.

Thermal efficiency = 2.486 × t/applied power amount - - - (1)

| | Ti | T2 | Td | Sp | E (%) |
|---|---|---|---|---|---|
| case of non-mounting shielding plate | 23.6 | 38 | 14.4 | 39.87 | 89.8 |
| case of mounting shielding plate | 23.4 | 37.6 | 14.3 | 39.92 | 89 |

Ti denotes the initial temperature, T2 denotes the temperature after two seconds, Td denotes the temperature difference, Sp denotes the supplied power mount, and E denotes the efficiency.

Accordingly, since the thermal efficiencies in the both cases of mounting and non-mounting the shielding plate are observed to be almost the same, the transmissivity is considered as favorable.

The cooking control process of the microwave oven in combination with the induction heating cooker having the shielding plate 200 will now be described.

Figure 4:
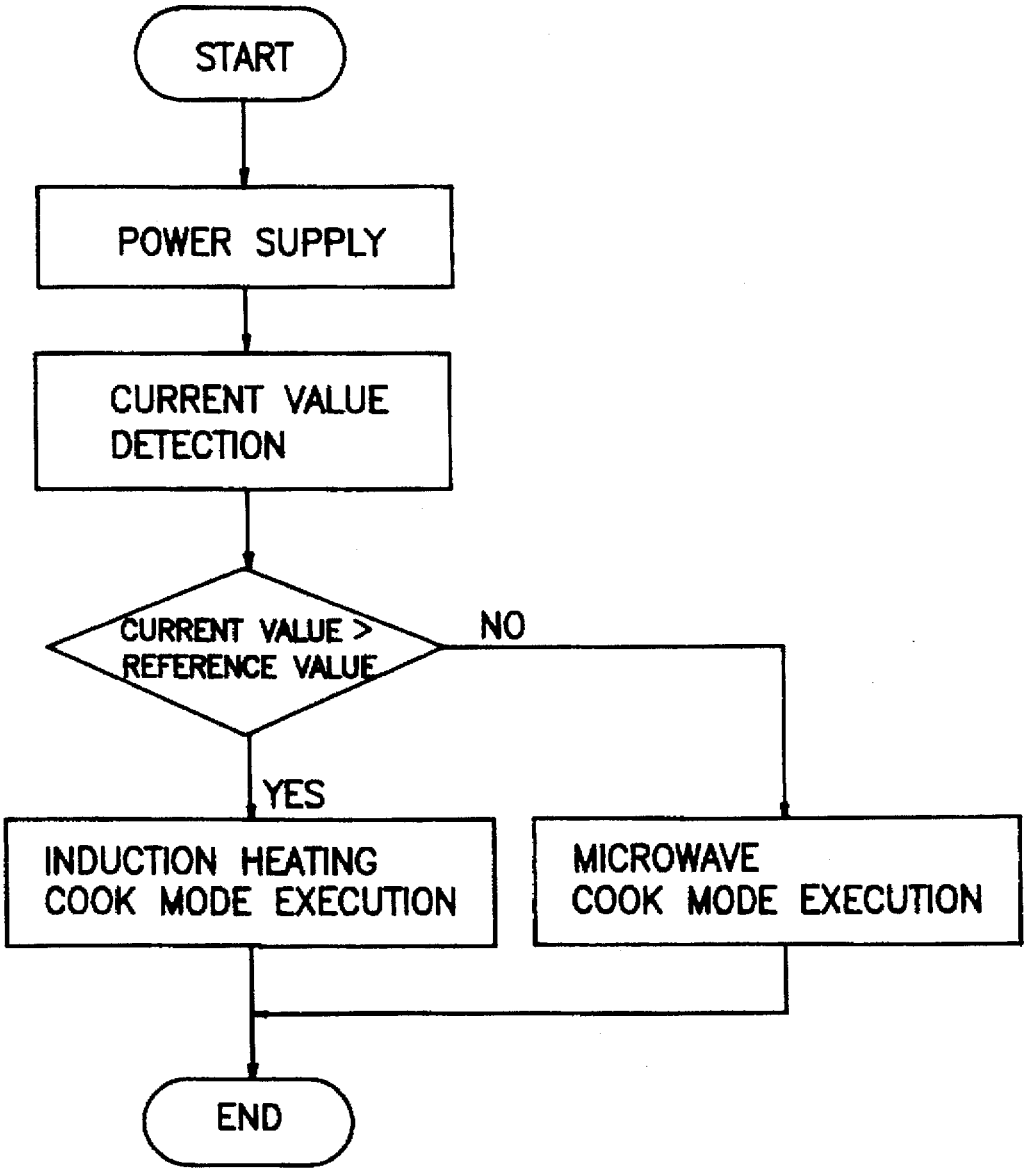
FIG. 4 is a signal flow chart of a cooking control process in the microwave oven in combination with an induction heating cooker applied to the present invention.

First, as shown in FIG. 4, when power is supplied to the microwave oven, a microprocessor senses a value of the induction current flowing to the induction coil 100 and then compares the sensed current value and a pre-set reference value.

Upon comparison, if the sensed current value is less than or the same as the reference value, the microwave cooking process is performed, of which description is omitted here because it was given above.

As so far described, in the microwave oven in combination with the induction heating cooker according to the present invention, the shielding plate disposed at the lower part of the heating chamber is provided with first and second metal line parts which are isolated at a predetermined interval, or first and second metal line parts are formed on the same plane of which each metal line is formed at predetermined intervals, or the shielding plates as constructed above are stacked as many as a predetermined number, so that microwave energy can be cut off in microwave cooking and the high frequency magnetic field generated during induction heating cooking is transmitted without any heating loss, thereby accurately executing a cooking mode as desired by a user. Moreover, an induction heating cooking mode and a microwave cooking mode are selectively executed by sensing the current mount flowing to induction coil which is mounted below the shielding plate, whereby the user can select a preferable mode effectively.

What is claimed is:

1. A microwave oven in combination with an induction heating cooker comprising:

a heating chamber;

a shielding means, located at a bottom portion of the heating chamber of the shielding means, including a first metal line part having a plurality of metal lines respectively arranged in parallel at regular intervals, and a second metal line part having a plurality of metal lines respectively arranged in parallel at regular intervals, the first metal line part being disposed in a manner in which the metal lines thereof form a predetermined angle with the metal lines of the second metal line part; and an induction coil means being disposed below the shielding means for generating an induction current when power is supplied thereto.

2. The microwave oven according to claim 1, wherein both an isolating interval between the first metal line part and the second metal line part and an isolating interval between each metal line respectively forming the first metal line part and the second metal line part of the shielding means are below 0.5 mm, respectively.

3. The microwave oven according to claim 1, wherein an insulating material is inserted between the first metal line part and the second metal line part of the shielding means.

4. The microwave oven according to claim 1, wherein a plurality of pairs of the metal lines of the first metal line part and the second metal line part which cross each other at said predetermined angle and at predetermined isolation intervals include a predetermined number of stacked pairs of said metal lines.

5. A microwave oven in combination with an induction heating cooker comprising:

a shielding means including a first metal line part having a plurality of metal lines respectively arranged in parallel at regular intervals; a second metal line part having a plurality of metal lines formed on the same plane as the first metal line part, the plurality of metal lines of the second metal line part having a predetermined length and being disposed at predetermined intervals on each metal line of the first metal line part, each of the plurality of metal lines of the second metal line part being arranged in a mutually alternately crossing manner such that a metal line of the second metal line part does not touch another metal line of the second metal line part; and an induction coil means being disposed below the shielding means for generating an induction current when power is supplied thereto.

6. The microwave oven according to claim 5, wherein each metal line forming the first and the second metal line parts of the shielding means is coated with an insulating material.

7. The microwave oven according to claim 5, wherein the shielding means is formed by stacking a predetermined number of a plurality of pairs of the first metal line part and the second metal line part.

8. A microwave oven in combination with an induction heating cooker comprising:

a heating chamber;

a shielding means located at a bottom portion of the heating chamber, the shielding means including a first metal line part having a plurality of metal lines respectively arranged in parallel at regular intervals, the first metal line part including cross wires having a predetermined length and being disposed at predetermined intervals on each metal line of the first metal line part, wherein the cross wires on neighboring metal lines are staggered; and an induction coil means being disposed below the shielding means for generating an induction current when power is supplied thereto.

* * * * *